US006074008A

United States Patent [19]

Gorgi et al.

[11] Patent Number: 6,074,008

[45] Date of Patent: Jun. 13, 2000

[54] DEVICE FOR ADJUSTING THE INCLINATION OF THE SEATING PORTION IN CHAIRS IN GENERAL

[75] Inventors: Claudio Gorgi; Daniela Zanetti, both of Rossano Veneto, Italy

[73] Assignee: Imarc S.P.A., Italy

[21] Appl. No.: 09/101,297

[22] PCT Filed: Dec. 20, 1996

[86] PCT No.: PCT/EP96/05794

§ 371 Date: Jul. 7, 1998

§ 102(e) Date: Jul. 7, 1998

[87] PCT Pub. No.: WO97/24955

PCT Pub. Date: Jul. 17, 1997

[30] Foreign Application Priority Data

Jan. 8, 1996 [IT] Italy ..... VE960001 U

[51] Int. Cl.[7] ..... B60N 2/02

[52] U.S. Cl. ..... 297/376; 297/344.19

[58] Field of Search ..... 297/328, 344.19, 297/301.4, 303.4, 354.12, 363, 364, 376, 374

[56] References Cited

U.S. PATENT DOCUMENTS

| | | |
|---|---|---|
| 1,361,799 | 12/1920 | Adams . |
| 2,090,376 | 8/1937 | Russell . |
| 2,827,951 | 3/1958 | Herider et al. . |
| 3,517,965 | 6/1970 | Cowles et al. . |
| 4,337,978 | 7/1982 | Kazaoka et al. . |
| 4,384,741 | 5/1983 | Flum et al. . |
| 4,739,959 | 4/1988 | Meiller . |
| 5,080,434 | 1/1992 | Locher . |

FOREIGN PATENT DOCUMENTS

| | | |
|---|---|---|
| 0 001 846 A1 | 5/1979 | European Pat. Off. . |
| 052 832 A2 | 6/1982 | European Pat. Off. . |
| 0 233 974 A1 | 9/1987 | European Pat. Off. . |
| 43 18 516 A1 | 12/1994 | Germany . |

*Primary Examiner*—Milton Nelson, Jr.
*Attorney, Agent, or Firm*—Hoffman, Wasson & Gitler

[57] ABSTRACT

A device for adjusting the inclination of the seating portion in chairs in general, to be applied to a support for the seating portion formed in at least two parts (2, 12) hinged together about a transverse axis (14) and associated with a spring (20) interposed between them to elastically maintain the back rest of the chair in its most forwardly inclined position, and also associated with a locking member (24) to maintain them in other predetermined positions corresponding to different inclinations of the back rest, characterised by comprising: a locking bolt (26) forming part of the locking member (24) and fixed to one (2) of the two parts (2, 12) of the support for the seating portion, a plurality of holes (22) provided in the other part (12) of the support for the seating portion in positions engageable by the bolt (26) and corresponding to different relative inclinations between the two parts (2, 12) of the support, a rod (30) for axially operating the bolt (26), an axially bistable device (34) for controlling the rod (30), a pair of preloaded springs (50, 52) interposed between the rod (30) and the bistable device (34), and an operating pusher (46) for the bistable device (34).

17 Claims, 4 Drawing Sheets

DEVICE FOR ADJUSTING THE INCLINATION OF THE SEATING PORTION IN CHAIRS IN GENERAL

FIELD OF THE INVENTION

This invention relates to a device for adjusting the inclination of the seating portion in chairs in general.

BACKGROUND OF THE INVENTION

Chairs provided with an adjustable back rest, adjustable alone or together with the seating portion if it forms a single body therewith, or synchronously with the seating portion but with a different angle of inclination are known. The purpose of this is to achieve the correct positioning for the particular work performed by the operator.

This adjustability of the inclination of the back rest, particularly alone, is generally obtained by hinging the rest support member about a transverse axis to the member mounted on the column of the chair base and supports the seating portion. The desired inclination of the back rest is achieved by locking the two members together in predetermined, angularly different positions.

However, in the case of inclination of the back rest together with or in synchronism with the seating portion, the adjustment is obtained by hinging together two separate parts forming the member for supporting the seating portion on the column. In the case of synchronized inclination between the seating portion and back rest, the back rest support member is hinged to one of the two parts forming the support member for the seating portion.

Considering the need to lock two hinged-together parts in different positions corresponding to different operator requirements, the system for locking these two parts together is generally a multiple type, i.e., with a locking bolt rigid with one of them and engaging a chosen one of several holes provided in the other part or alternatively with a comb structure rigid with one of them and engaging with a chosen one of the spaces between its teeth and an edge of the other part.

The most forwardly inclined position of the back rest is achieved by a spring between the back rest support member and the seating portion support member. The other rearwardly inclined positions are achieved by stress of the seated operator, and who by a rearward thrust, loads the spring until the desired inclination is achieved. This is permanently maintained by activating the locking system.

This system for elastically returning the back rest into its most forwardly inclined configuration involves the risk of sudden return into that configuration if the locking device is deactivated voluntarily or accidentally when the operator is not seated on the chair. This is the cause of possible danger and conflicts with current accident prevention regulations.

To eliminate this drawback it has already been proposed to make operation of the locking system (for activation or deactivation) possible only when the operator is seated on the chair and can oppose the elastic reaction on the return spring by his own presence.

For example, Italian utility model application BS91U000068 describes a chair adjustment device comprising a comb-type locking member activated and deactivated by a lever via a control rod provided with springs loaded by the operator seated on the chair, but which can move the comb member only after the operator has set the chair into the correct position for allowing this movement and has mechanically rigidly locked together the two parts of the support for the seating portion.

A drawback of this arrangement is that, if it is also required to adjust the height of the seating portion, a second lever must be provided, not only complicating the chair construction, but also causing operating difficulty and uncertainty because of the inevitable risk of confusing the two levers.

A further drawback, again related to the presence of the two levers, is that they have to be located on opposite sides of the chair so their operation requires the use of both hands.

A further drawback is that the lever for adjusting the inclination of the seating portion requires accurate construction and likewise accurate positioning on the chair. As the lever for adjusting the height of the seating portion is usually positioned on the right, the lever for adjusting the inclination of the seating portion is constructed to be always positioned on the left and could not be positioned on the right even if the lever for adjusting the height of the seating portion is not provided.

A further drawback is that the maneuvers to be carried out on the lever to lock and release the seating portion are opposing, i.e., are different from each other. This results in a possible operational uncertainty by the operator, who cannot always immediately remember which of the two operations has to be carried out to lock or release the seating portion.

A further drawback is that the system for operating the manual locking member of a rigid rod involves the need to apply the control lever in a precise position, which is generally in proximity to the inclination mechanism of the seating portion.

A further drawback is a certain complexity of construction and assembly, both of the locking member and of its operating device.

According to the invention, all these drawbacks are eliminated through a device for adjusting the inclination of the seating portion in chairs.

BRIEF DESCRIPTION OF THE DRAWINGS

A preferred embodiment of the of the present invention is further described hereinafter with reference to the accompanying drawings, in which.

DETAILED DESCRIPTION OF THE INVENTION

As can be seen from the figures, the adjustment device comprises a box structure 2 on the lower surface of the seating portion (not shown) of a chair, and provided with a frustoconical bushing 4 for insertion of the upper end of the rod of a traditional gas spring 6. The gas spring supports the box structure 2 on a support base while at the same time adjusting the height of the seating portion.

Figure 1:
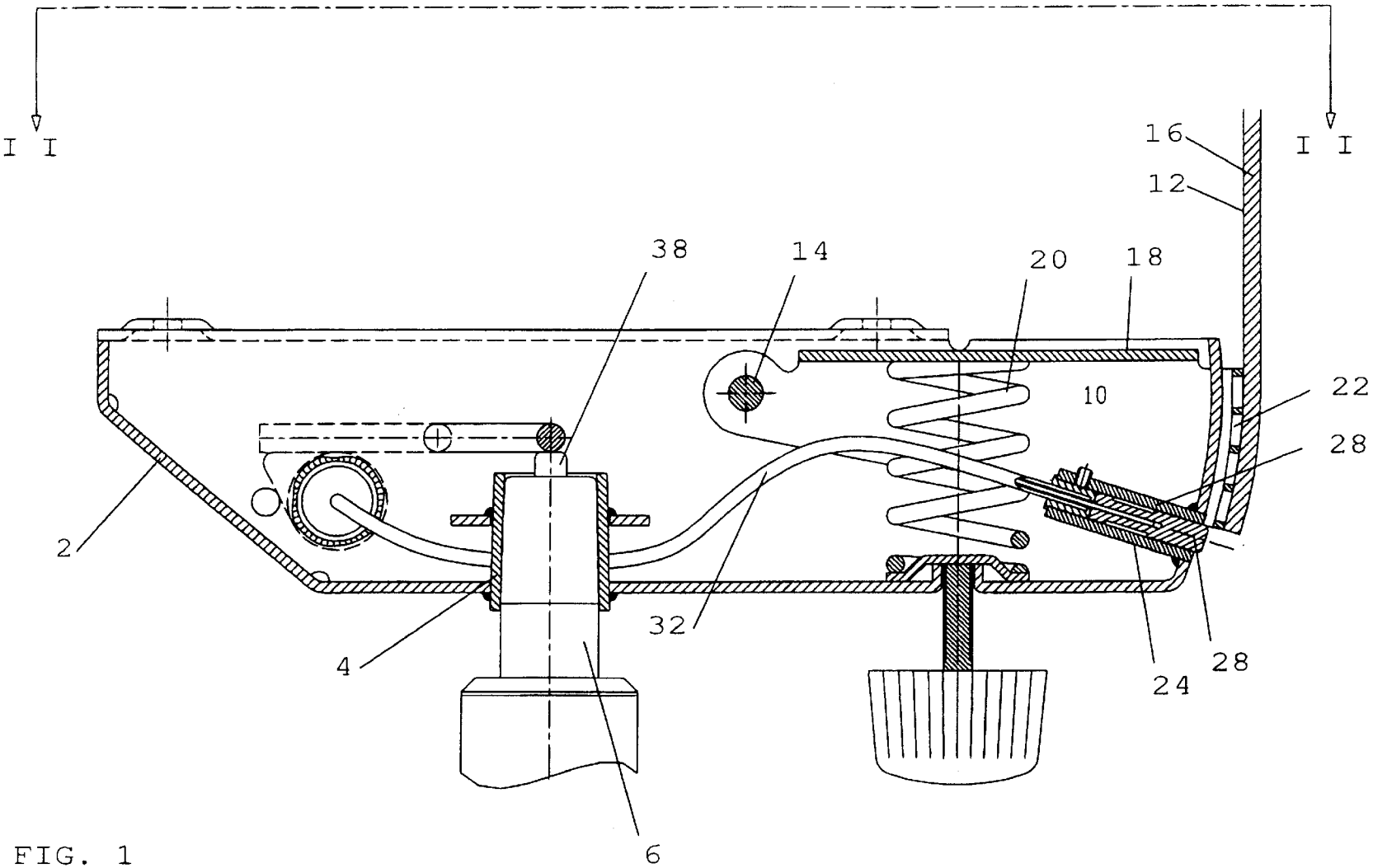
FIG. 1 is a vertical section through the device of the invention to be applied to a chair for a video terminal operator with its back rest adjustable relative to its seating portion.
Figure 2:
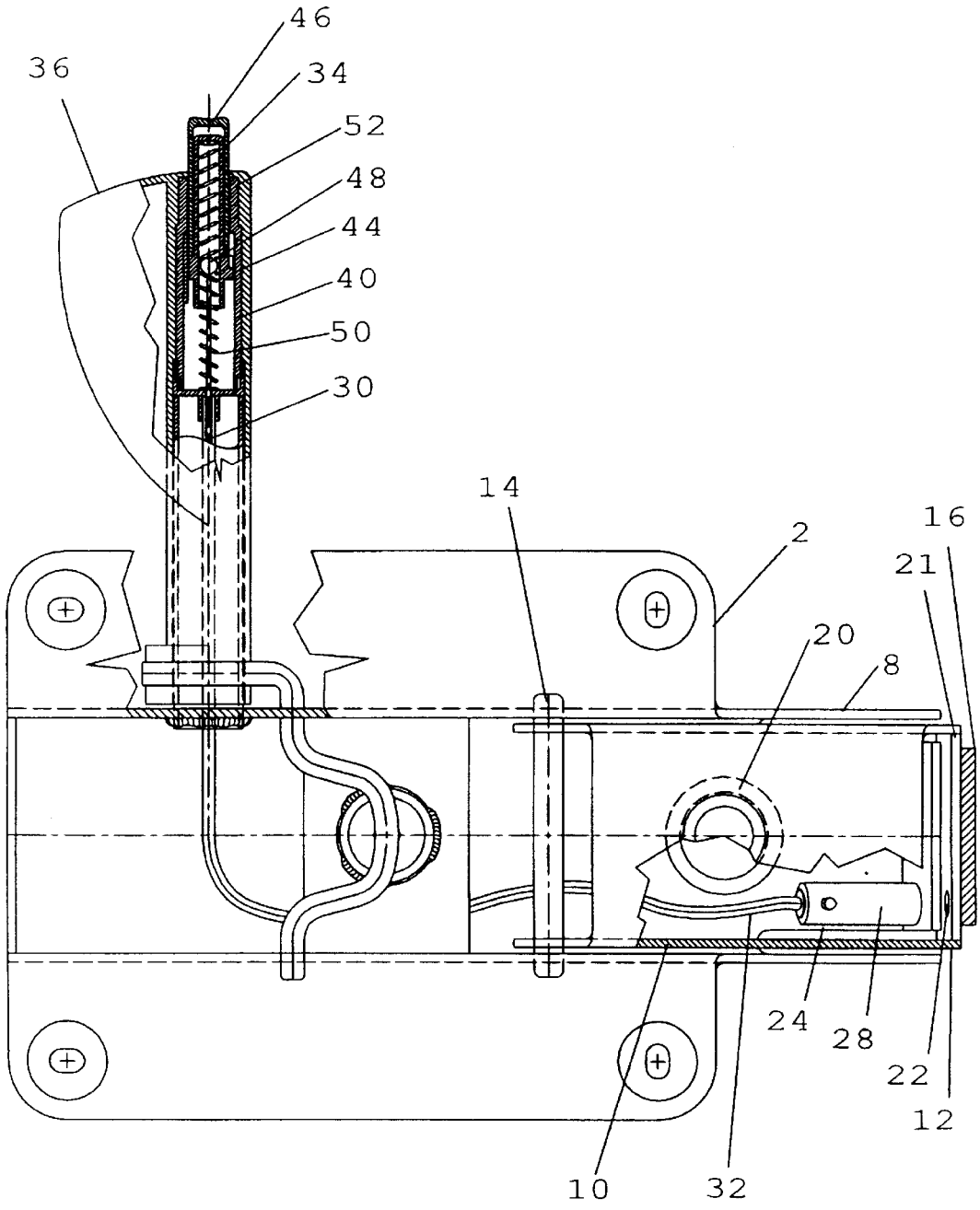
FIG. 2 is a partly sectional plan view thereof taken in the direction II—II of FIG. 1.

As seen in FIG. 2, the box structure 2 is provided with two spaced-apart longitudinal shoulder 8 between which there are interposed the flanges 10 of a member 12 for supporting the back rest (not shown) and for hinging it to the seating portion. The support member 12, is hinged to the box structure 2 by a transverse pin 14 passing through the shoulders 8 and the flanges 10. In addition to the flanges 10, a bracket 16 attached to the back rest is applied. Upper plate 18 connects the flanges together. Against this plate a spring 20 lowerly rests on the base of the box structure 2, in order to elastically maintain the back rest in its most forwardly inclined posit-on, as will be explained later.

A curved wall 21 connects the two flanges 10 of the member 12 together. To this wall the bracket 16 is fixed. There are a plurality of aligned holes 22 such that, when the support member 12 rotates relative to the box structure 2 about the pin 14, they all face a locking member 24 comprising a locking bolt 26 slidable axially within a cylindrical housing 28 fixed to the box structure 2. The bolt 26 is movable axially between two end positions where it respectively engages and disengages one of the holes 22, and is controlled in these movements by a flexible rod 30 housed in a flexible sheath 32 connecting the locking member 24 to an operating device of push type, indicated overall by 34.

The operating device 34 can generally be fixed to any part of the chair and is incorporated in the illustrated example into the lever 36 which, when rotated, controls the valve 38 of the gas spring 6 in a traditional manner to enable the height of the chair seating portion to be adjusted.

In detail, the operating device 34 comprises a cylindrical casing 40 closed at one end by a base 42. The base is traversed by the flexible rod 30 against which the end of the sheath 32 rests.

Within the cylindrical casing 40 there is a slidable piston 44. The axial movements of the piston can be controlled by a pusher 46 emerging from the end of the casing distant from that closed by the base 42.

The end of the flexible rod 30 within the operating device 34 has with an enlargement 48 freely slidable within an axial cavity in the piston 44. Against the flexible rod rest two preloaded springs 50, 52. The spring 50 is interposed between the enlargement 48 and the base 42, and the other spring 52, opposite the first spring, is interposed between the enlargement 48 and the closed end of the piston 44.

The operating device 34, comprising the cylindrical casing 40, the piston 44, the pusher 46 and the springs 50,52 can be defined as a pusher-operated axially bistable device. It is a device with a part, namely the piston 44, able to assume two axially different stable positions. Each position can be attained by axially pressing the pusher 46 in the direction of the base 42 of the casing 40, in a like manner to that which occurs with a pusher of a traditional ballpoint pen. As this type of operation is known, a detailed description of its operation will be omitted for simplicity, as will any reference to other already known details.

Figure 3:
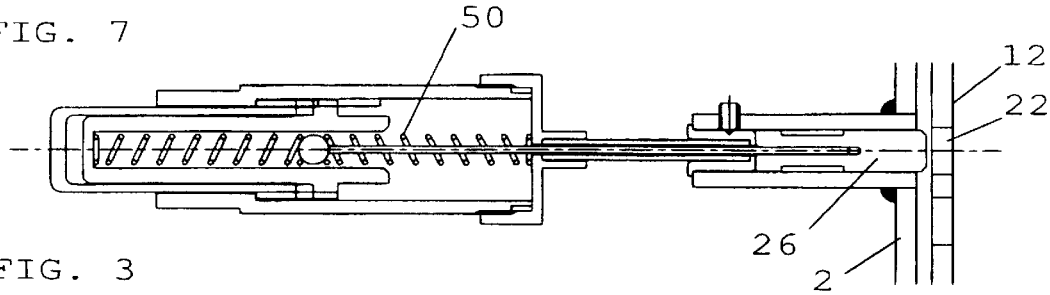
Figure 8:
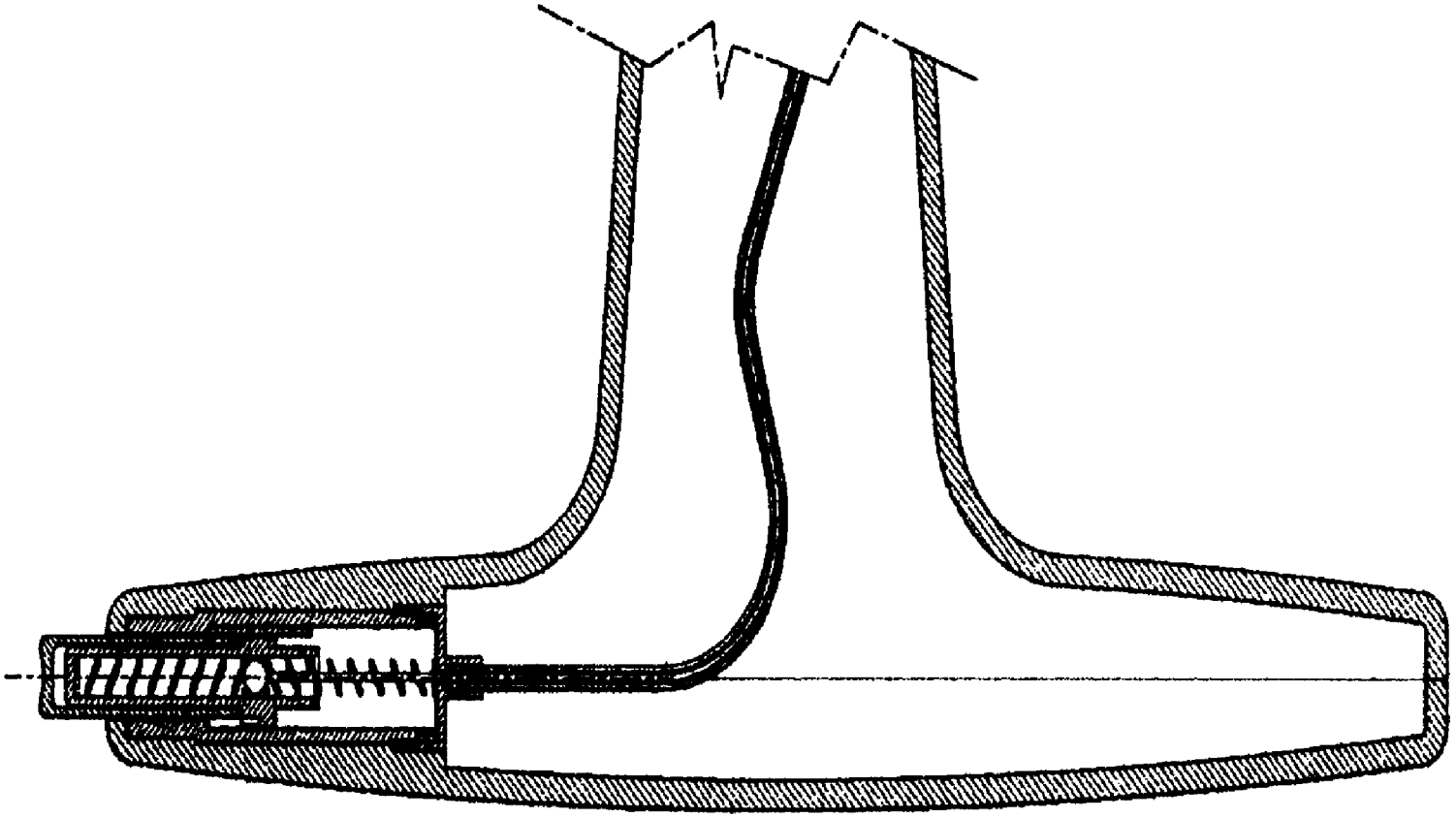
FIG. 8 depicts an actuator housed within an arm rest.

The operation of the locking device will now be described with reference, for simplicity of description, to the condition illustrated in FIG. 3, in which the locking member 24 is deactivated. The bolt 26 is in its retracted position within its housing 28, and does not engage any of the holes 22 provided in the curved wall 21 of the support member 12.

In this condition, which is made stable by the balancing effect of the two springs 50 and 52 on the enlargement 48 of the rod 30, the back rest can be freely inclined rearward by the effect of the thrust of the operator seated on the chair, and forward by reducing this thrust to a sufficient extent to enable the spring 20 interposed between the box structure 2 and the support member 12 to react elastically.

Figure 4:
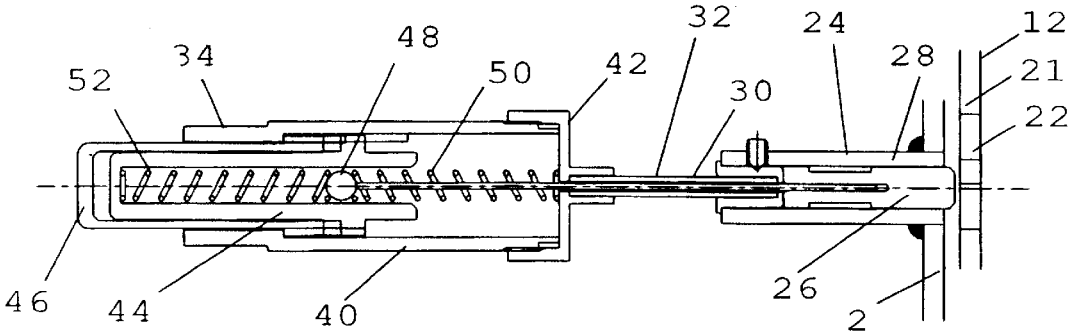
FIGS. 3 to 7 are five longitudinal sections showing different operating conditions of the control member of the adjustment device.
Figure 5:
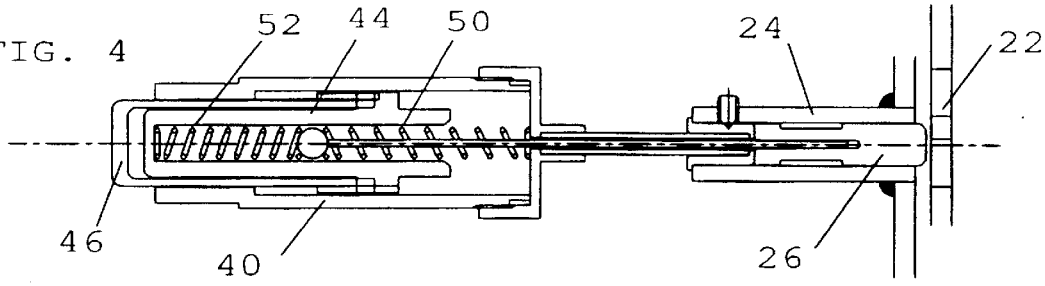

If, under these conditions, the operator, after attaining approximately the desired degree of inclination of the back rest, instantaneously operates the pusher 46, the interaction between this, the piston 44 and the cylindrical casing 40 moves the piston 44 into the other end position. This loads the spring 52 to a greater extent than the spring 50 (see FIG. 4). This non-uniform stressing of the two springs 50 and 52 does not result in activation of the locking member 24 because generally the locking bolt 26 does not face a hole 22 into which it can enter. If, following a small inclination movement in one or other direction, a hole 22 exactly faces the locking bolt 26, the elastic reaction of the loaded spring 52 urges the bolt to engage the hole and to mechanically lock the box structure 2 and the support member 12 together (see FIG. 5), even if the operator leaves the chair.

Figure 6:
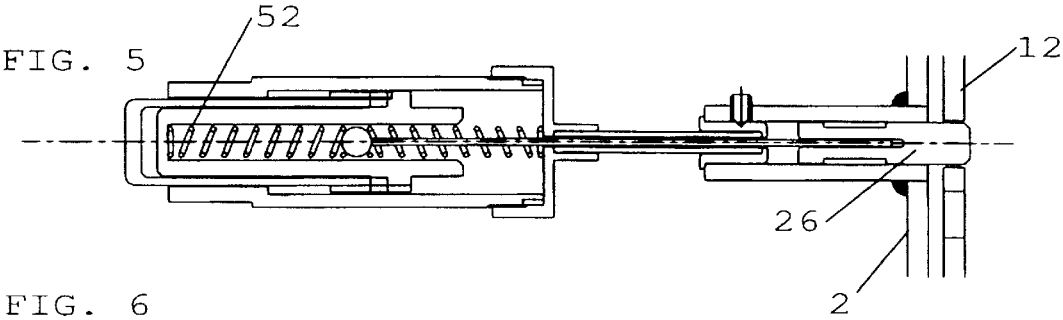

To release the back rest in order to vary its inclination, the operator must first again operate the pusher 46 which, as a result of this operation, is subjected to the elastic action of the preloaded spring 52, which extends and returns the piston 44 into its other end position (see FIG. 6). However this movement does not result in any extension of the spring 50, because the locking bolt remains in its locking position by friction due to the tangential force induced between the box structure 2 and the support member 12 by the spring 20 interposed between them.

Figure 7:
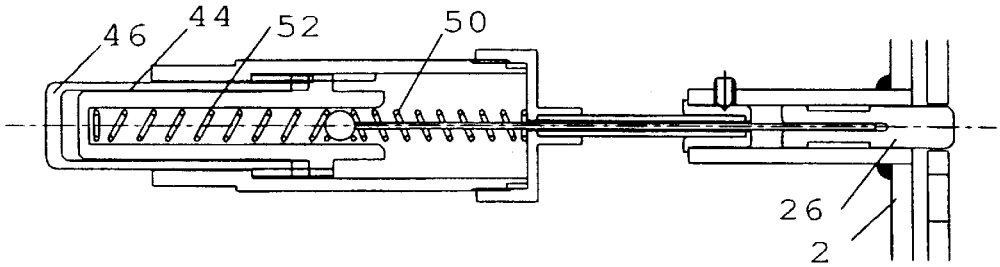

However, when the operator sits on the chair so that his weight causes a slight movement between the box structure 2 and support member 12, sufficient to cause exact alignment between the bolt 26 and the hole engaged thereby, the elastic reaction of the spring 50 prevails. The bolt 26 withdraws from the hole 22 (see FIG. 7) and enables the operator to move the back rest into the new chosen configuration. The operator can lock it by again operating the pusher 46 in the aforedescribed manner.

The adjustment device of the invention is extremely advantageous compared with traditional devices, and in particular:

- it enables the operator to lock and release the back rest by the same operation, without any uncertainty or confusion,
- it can be controlled by a pusher which can be positioned either to the right or left of the chair at will,
- it is practically positionable in any position within the box structure supporting the seating portion, and in particular can be incorporated into the lever which adjusts the height of the seating portion,
- it requires no force for the locking or release operation, but simple instantaneous pressure on the presser,
- if the control rod of the locking member is of flexible type, i.e., in the form of a cable housed in a sheath, the position of the pusher, i.e., the control member, can be chosen at any point of the chair, for example even on the arm rest,
- it is of extremely simple construction, using only a few components.

The drawings show a device applicable to a chair with its back rest inclinable to the seating portion rigid with the chair support base.

The invention is also applicable to chairs with a one-piece body supported by a support structure hinged to a structural part rigid with the support base. It is also applicable to chairs of so-called synchronized inclination of the seating portion and back rest. In this case, the support structure for the seating portion comprises a first part rigid with the support base, a second part rigid with a seating portion and hinged to the first about a first transverse axis, and a third part rigid with a back rest and hinged to the second about a second transverse axis and also connected to it by means for synchronizing the inclination movements of the seating portion and said back rest.

In an embodiment (not shown on the drawings) the rod 30 is substantially rigid.

We claim:

1. A chair, comprising:

a seating portion, a back rest portion, a device for adjusting the inclination of the back rest portion, the device comprising, a housing, a plate pivotably, connected to the housing, the plate having holes, a locking member connected to the housing, a locking bolt axially slidable with the locking member, for engagement with holes in the pivotable plate, an actuator for moving the locking bolt, a rod extending between the actuator and the locking bolt;

wherein the rod extends into a piston, the end of the rod provided with an enlargement, and a first and second spring within the piston bearing against the enlargement.

2. The chair of claim 1, further comprising a cylindrical casing having a base and a pusher opposite the base, the pusher engaging the piston to cause its movement.

3. The chair of claim 2, wherein the first spring extends between the cylindrical casing base and the enlargement and the second spring extends between the piston and the enlargement.

4. A chair, comprising:

a seating portion, a back rest portion, a device for adjusting the inclination of the back rest portion, the device comprising, a housing, a plate pivotably, connected to the housing, the plate having holes, a locking member connecting to the housing, a locking bolt axially slidable with the locking member, for engagement with holes in the pivotable plate, an actuator for moving the locking bolt, a rod extending between the actuator and the locking bolt;

wherein the rod extends into a piston, the end of the rod provided with an enlargement, and a first and second spring within the piston bearing against the enlargement; and means for adjusting the height of the chair, a lever for activating the means for adjusting the height, the actuator housed within the lever.

5. A device for adjusting the inclination of a back rest portion in a chair, said chair comprising a seating portion and a back rest portion, said device comprising:

a support consisting of at least first and second parts hinged together about a transverse axis, a spring interposed between said first and second parts, a locking member, a locking bolt axially slidable with said locking member and fixed to said first part of the support, a plurality of holes provided in the second part of the support, said holes being engageable by the locking bolt and corresponding to different relative inclinations between said first and second parts of said support, a rod for axially operating said bolt;

an axially bistable device for controlling said rod, first and second preloaded springs interposed between said rod and said bistable device, and an operating pusher for said bistable device.

6. A device as claimed in claim 5, wherein said first part of the support is rigid with a seating portion and said second part is rigid with a bracket supporting a back rest portion.

7. A device as claimed in claim 5, wherein said first part of the support is rigid with a chair support base and said second part is rigid with a chair body.

8. A device as claimed in claim 5, wherein the support is formed in three parts, of which the first part is rigid with a chair support base, the second part is rigid with a seating portion and is hinged to the first part about a first transverse axis, and the third part is rigid with a back rest portion and hinged to the second part about a second transverse axis and is also connected to it by means for synchronizing the inclination movements of said seating portion and said back rest portion.

9. A device as claimed in claim 5, wherein the second part of the support comprises a curved portion provided with holes.

10. A device as claimed in claim 5, wherein said locking member comprises a cylindrical housing within which the locking bolt is axially slidable.

11. A device as claimed in claim 5, wherein said rod is flexible and is housed in a flexible sheath.

12. A device as claimed in claim 5, wherein said rod is of rigid type.

13. A device as claimed in claim 5, wherein said axially bistable device and said operating pusher are housed in a body of a lever which adjusts the height of said seating portion.

14. A device as claimed in claim 5, wherein said axially bistable device comprises a cylindrical casing provided at one end with said operating pusher and within which a piston is axially slidable between two end positions, within said piston there being positioned the end of said rod, which is provided with resting means interposed between said first and second preloaded springs.

15. A device as claimed in claim 14 wherein said first spring is interposed between the resting means on the rod and a closed end of said piston, and said second spring is interposed between said resting means and a closed base of said cylindrical casing.

16. A device as claimed in claim 15, wherein said base of said cylindrical casing is traversed by a flexible rod and supports an end of a sheath.

17. A device as claimed in claim 16 to be applied to chairs with arm rests, wherein the axially bistable device and its operating pusher are housed in an arm rest.

* * * * *